United States Patent [19]

Haydu

[11] Patent Number: 4,895,116

[45] Date of Patent: Jan. 23, 1990

[54] SAFETY DEVICE FOR MOTOR VEHICLES

[76] Inventor: John Haydu, P.O. Box 585, Linden, N.J. 07036

[21] Appl. No.: 275,125

[22] Filed: Nov. 22, 1988

[51] Int. Cl.[4] ..... F02B 77/00

[52] U.S. Cl. ..... 123/198 D; 123/325

[58] Field of Search ..... 123/198 D, 325

[56] References Cited

U.S. PATENT DOCUMENTS

| | | | |
|---|---|---|---|
| 4,150,654 | 4/1979 | Heitzman et al. | 123/198 D |
| 4,295,540 | 10/1981 | Hildebrecht | 123/198 D |
| 4,452,196 | 6/1984 | Indra | 123/198 D |

*Primary Examiner*—Noah P. Kamen

*Attorney, Agent, or Firm*—Kenyon & Kenyon

[57] ABSTRACT

Safety device for motor vehicles utilizes a cam-like plate and linkage to prevent accidental acceleration of a motor vehicle when disengaging the vehicle's shift lever from the park or neutral position. The apparatus employs an electrical circuit to detect the position of the shift lever and the activation and deactivation of the brake foot pedal. Only after placing the vehicle into any drive position other than park or neutral, and releasing a pedally operated brake pedal, will the linkage permit the throttle of the motor vehicle to move from its idle position to any position selected by the operator upon later application of an operating force to the accelerator pedal. In this manner, the operator is assured that the motor vehicle will not accidentally be caused to lurch forward or backward at high speed.

8 Claims, 2 Drawing Sheets

SAFETY DEVICE FOR MOTOR VEHICLES

BACKGROUND OF THE INVENTION

This invention relates to safety devices for motor vehicles, and more particularly to a device that is utilized to protect against accidental operation of the vehicle's throttle or fuel injection system.

The prior art utilizes a variety of techniques to prevent the accidental acceleration of motor vehicles when engaging the motor vehicle's drive assembly from a park or neutral position into any forward or reverse gear configuration. Such systems include instructing the operator of the motor vehicle to insure that the vehicle operator maintains pressure on the brake foot pedal during the initial shifting operation from park or neutral into a drive position. Other safety devices include detents of substantial depth to insure that the motor vehicle's gears will not accidentally engage when the gear-operating lever is disposed in a park or neutral position.

However, there exists the phenomenon in certain motor vehicles wherein when the operator intentionally removes the motor vehicle's gear-shift lever from the park or neutral position to the drive or reverse position the vehicle will suddenly accelerate as if by depressing the accelerator foot pedal, despite the operator not providing any application of force to the accelerator pedal. Experience has shown that the vehicle's engine throttle, for an unknown reason, appears to open at the time of the initial shifting of the gears. This difficulty has been conjectured as a function of unwanted hydraulic coupling effects between the various mechanisms of the motor vehicle. Certain automobile manufacturers, however, have claimed that the cause of this sudden acceleration stems from operator carelessness.

The present invention has been developed to overcome any inadvertent application of fuel to the engine of the motor vehicle until such time as the vehicle operator is fully prepared to go forward or backward, and wherein the throttle, at such time, starts at a rest or dwell position and can only be advanced upon the intentional application of force to the accelerator pedal by the operator.

SUMMARY OF THE INVENTION

The primary object of the present invention is to provide a vehicle safety device that will, at all times, prevent the application of unwanted fuel into the throttle or fuel injection system of a motor vehicle unless the vehicle operator intentionally places the vehicle drive lever in a drive or reverse position and releases the brake foot pedal.

Another object of the present invention is to provide a vehicle safety device which will not permit the motor vehicle to accidentally move unless the operator first depresses the brake foot pedal during or after engine startup and then intentionally releases same.

Still another object of the present invention is to provide a mechanically sound vehicle safety device, which functions independently of the hydraulic system of a motor vehicle, thereby protecting against inadvertent dynamic coupling and interaction with such hydraulic system.

Yet another object of the present invention is to provide a vehicle safety device which is inexpensive to manufacture and simple to install on existing motor vehicles.

A further object of the present invention is to provide a vehicle safety device which can be easily installed, easily fabricated, and fitted upon vehicles at the time of their initial manufacture.

Heretofore, motor vehicles have been equipped with throttle or fuel injection operating systems which are coupled to the pedally operated accelerator pedal. Such linkages are either hydraulic or mechanical. The throttle or fuel injection systems are usually coupled to a portion of the throttle or fuel injector, respectively, by way of an arm which rotates about a pivot point. When this arm is in a rest position, the engine is at idle and running at slow speeds. The rest position is normally adjustable by a threaded screw so as to control the idle rate of the engine. When the throttle or fuel injection arm is pivoted away from the rest position, more fuel is permitted to enter into the engine, causing the engine to accelerate to higher speeds.

If during high speed operation of the engine, the gear train then couples the engine to the wheels of the vehicle, the vehicle will lurch radically from a standing position in a forward or reverse direction, dependent upon which set of gears are engaged. Thus, in the event that the throttle or fuel injection arm is away from the rest position during those times that the gear train of the motor vehicle is engaged in a drive (forward or reverse) position, unintended rapid acceleration of the vehicle can occur. If the amount of deviation of the throttle or fuel injection arm is great relative to the rest or idle position, then the vehicle can achieve great speeds, resulting in a dangerous situation, often producing collisions and injury to operators, passengers, and nearby persons and vehicles.

The present invention eliminates the potential for the unexplained deviation of the throttle or fuel injection arm from the rest position into a high speed motor operating position by interposing a cam-like plate into a position which prevents the throttle or fuel injection arm from moving from its normal or rest position until the operator of the motor vehicle intentionally places the motor vehicle's gear train in any drive position other than park or neutral and then removes his foot from the brake pedal, which must have been previously depressed, in order to then pedally operate the foot operated accelerator pedal. As long as the brake foot pedal is depressed, it is impossible for the throttle or fuel injection arm to move from its rest position. Once the operator has released the brake pedal, after first being assured that no high engine speed has been attained, the safety plate is removed from engagement and the throttle or fuel injection arm is free to pivot to the extent dictated by the selected amount of depressive force upon the accelerator pedal.

Since the unknown cause for instantaneous accidental acceleration appears to occur at the time that the gear train operating lever is removed from the park or neutral position, a small amount of time delay is built into the present circuitry to insure that even if the operator removes his or her foot from the brake pedal simultaneously with the manual operation of the gear train from park or neutral into a drive position, the safety plate does not instantaneously disengage the throttle or fuel injector arm during such time interval. Thus, the operator is given a short time period following the time the brake pedal is released, in the event that the engine then inadvertently begins its acceleration.

At all other times of vehicle operation, once the motor vehicle's gear train has been first engaged, the safety device is out of operation and does not impede the normal operation of the motor vehicle. However, at any time that the vehicle is put into the park or neutral position, despite the fact that the vehicle ignition system has remained on, the safety device will again become operational until the brake pedal is depressed and released, so as to prevent the unintended acceleration of the engine of the motor vehicle.

Since the present invention does not create the need to interrupt or disrupt any of the vehicle's hydraulic or mechanical linkages, and simply comprises a safety device added to a motor vehicle, it can be easily added to existing motor vehicles either as original factory equipment or after the vehicles have been put into use.

These objects as well as other objects of the present invention will become more readily apparent from the following description and the accompanying drawings.

DESCRIPTION OF THE PREFERRED EMBODIMENT

The present invention pertains to motor vehicles which may have the tendency to accidentally accelerate upon the motor vehicle's gear train being moved from the park or neutral position and engaged in any drive position. At such times it is known, for reasons which are unclear, that the engine of the motor vehicle may begin to suddenly accelerate. This unexpected acceleration, coupled with the fact that the motor vehicle is initially at rest and that the operator is usually unprepared for the sudden acceleration, results often times in severe injury to the motor vehicle, its operator, passengers, and nearby persons. Property damage can be substantial. Fatalities have been known to occur.

The present invention utilizes an electrically-operated solenoid to position a safety plate or cam-like plate into a safety position at all times that the motor vehicle's ignition circuit is energized and when the gear train of the motor vehicle is put into a park or neutral position. Only when the gear train of the motor vehicle is positioned into any drive position, followed by the vehicle's operator removing his or her foot from the foot operated brake pedal and a short time delay, will the operating arm of the throttle or fuel injection system be permitted to move from its normal idle or rest position into an advanced position whereby larger quantities of fuel may enter the engine's carburetor or fuel injection system, causing the motor vehicle's engine to operate at speeds higher than an idling speed. As a result, it is impossible for the engine of the motor vehicle to accidentally accelerate, regardless of the cause. Since the present invention constitutes an addition to the motor vehicle, it is not dependent upon the installed hydraulic system and other components of the motor vehicle, except for the vehicle battery, the foot operated brake switch and accelerator switch and gear train mechanisms.

Figure 1:
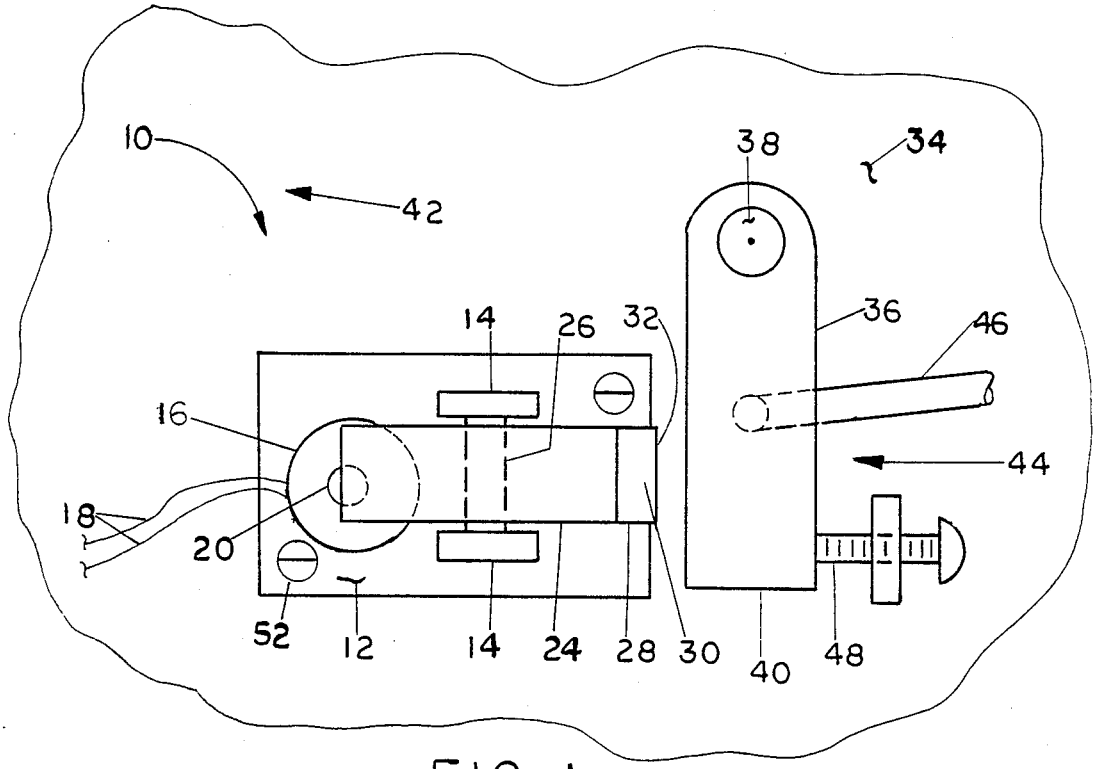
FIG. 1 is a plan view of the present apparatus shown in conjunction with the throttle arm and linkage to a carburetor or fuel injection system of a vehicle.

Now, referring to the figures and more particularly to the embodiment illustrated in FIG. 1, the present invention 10 is shown comprising a mounting plate 12 upon which there are erected two columns 14. Attached to mounting plate 12 is solenoid 16 from which operating wires 18 extend. Plunger-like rod 20 is operated by solenoid 16 such that when solenoid 16 is energized, arm 20 has end 22 thereof emerge outwardly from solenoid 16. Safety plate 24 is pivotally mounted on columns 14 along pivot rod 26. End 28 of safety plate 24 is shown adapted with member 30 having exposed surface 32 thereon. A portion of the motor vehicle is shown by wavy lines 34 to which the throttle or fuel injection operating arm 36 is attached by way of pivot rod 38. When end 40 of the throttle or fuel injection arm 36 is moved in the direction of arrow 42 by the exertion of a force in the direction of arrow 44 along linkage arm 46, the engine (not shown) will accelerate. When the throttle or fuel injection arm 36 is disposed in a direction opposite to arrow 42, end 40 thereof comes into contact with idling set screw 48 as shown. In the event that safety plate 24 has surface 32 disengaged from arm 36, end 40 of arm 36 can move unrestrictedly in the direction of arrow 42.

Figure 2:
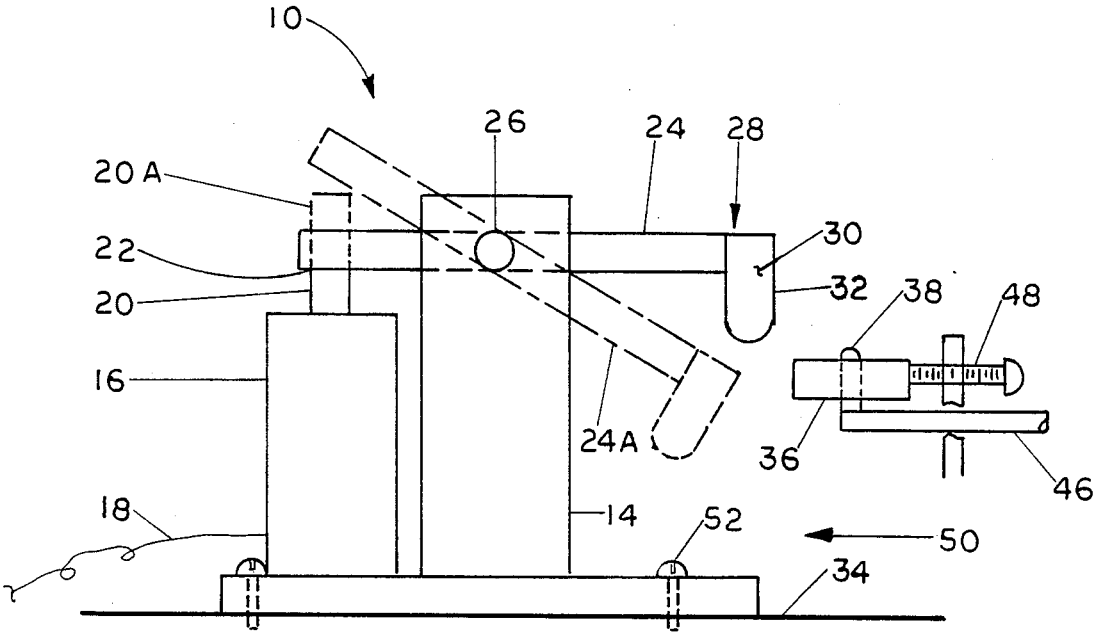
FIG. 2 is a side elevation view of the apparatus shown in FIG. 1.

FIG. 2 illustrates the apparatus shown in FIG. 1, wherein surface 32 is disposed out of engagement with arm 36. However, when solenoid arm 20 moves into position shown by dotted lines 20A, as by actuation of the solenoid 16, then plate 24 moves into the position shown by dotted lines 24A, thus prohibiting the throttle or fuel injection arm 36 from moving in the direction of arrow 50. Screws 52 may be utilized to fasten plate 12 to any convenient part of the engine, such that surface 32 engages arm 36 preventing its motion from the normal or idle position when desired.

Figure 3:
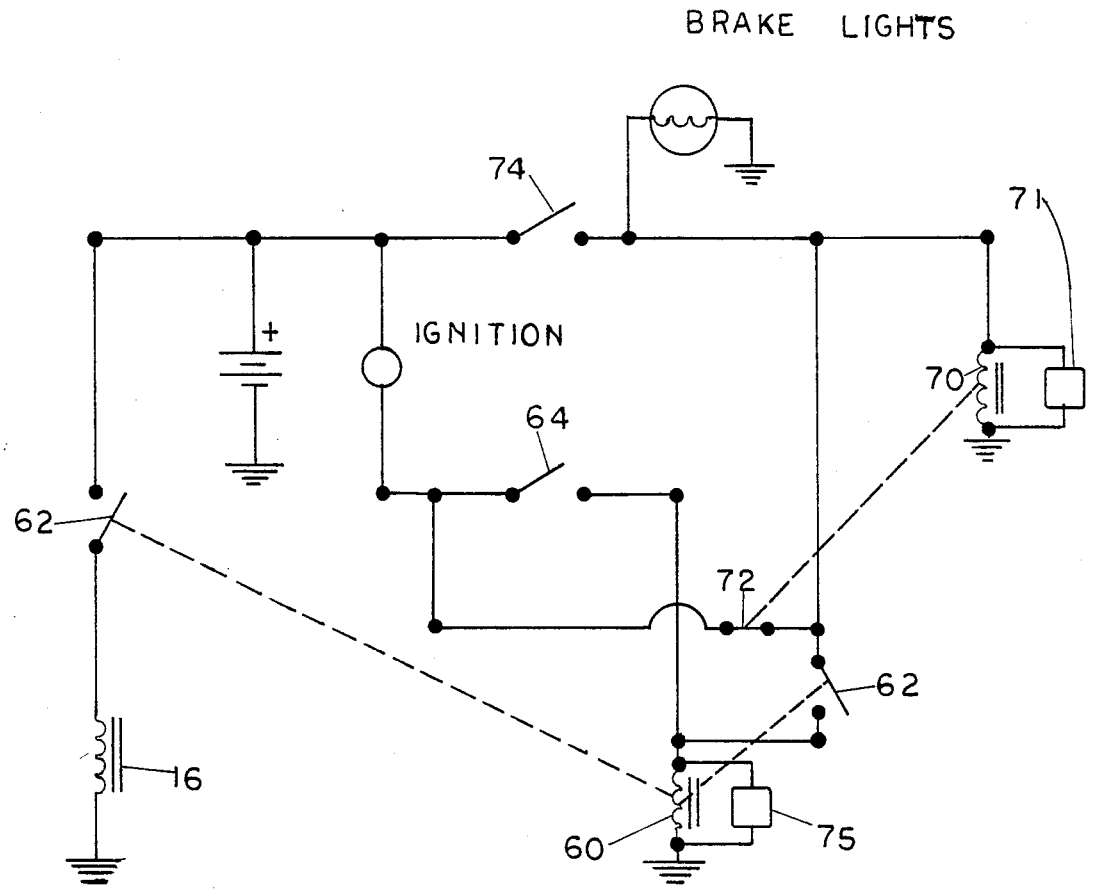
FIG. 3 is an electrical schematic of the electrical circuitry of the present invention.

FIG. 3 is an electrical schematic of the preferred embodiment of the present invention, in which a first relay 60 is connected to the park and neutral switch 64 of the apparatus. As such, first relay 60 would become energized and the normally open contacts 62 of relay 60 would close when the motor vehicle engine is started with the gear switch 64 in the park or neutral position, thereby energizing the solenoid 16. The solenoid 16 will remain energized for as long as relay 60 is energized.

A second relay 70 has one side of the coil thereof connected to the ground circuit of the motor vehicle. Such second relay 70 becomes energized and the normally closed contact 72 of relay 70 would open, provided the battery of the motor vehicle is operational, when the brake pedal is depressed, closing the brake switch 74.

Generally, to start the engine of the motor vehicle, the gear train must be placed in the park or neutral positions. Upon starting the engine, electrical power from the vehicle's battery will flow through the closed gear switch 64 to energize first relay 60, closing first relay contacts 62 and thereby actuating solenoid 16 to prevent operation of the vehicle's throttle or fuel injector arm in other than an idle position.

Solenoid 16 will be actuated upon starting the motor vehicle's engine whether or not brake switch 74 is closed. For example, if the engine is started without the operator depressing the brake pedal, brake switch 74 will remain open and second relay 70 will not be energized. Nonetheless, solenoid 16 will be energized as described above through the closed gear switch 64 circuit.

If, on the other hand, the engine is started with the brake pedal depressed, brake switch 74 will be closed, second relay 70 will be actuated and second relay contact 72, which is normally closed, will be opened.

Solenoid 16 will again be energized through the closed gear switch 64 circuit.

Once solenoid 16 is actuated, the brake pedal must be depressed and released before the motor vehicle is put into operation. While moving the gear lever from a park or neutral position will open gear switch 64, first relay 60 and solenoid 16 consequently, will remain actuated through closed first relay contacts 62. Only upon releasing the depressed brake pedal, thereby opening brake switch 74, will both relays 60 and 70 be deactivated and solenoid 16 deenergized. A time delay 71 is built into the second relay contact 72 to ensure that first relay contacts 62 will open before second relay contact 72 closes which prevents first relay 60 from remaining energized. A further time delay circuit 75 can be provided to cause a short time lapse of a few seconds between deenergization of first and second relays 60 and 70 and deenergization of solenoid 16, to allow the operator additional time to ensure that the motor vehicle's engine is not accelerating accidentally before beginning routine operation of the motor vehicle. Such time delay circuitry can take the form of capacitors or other elements well known to those of ordinary skill in the art.

After the motor vehicle gear train has been placed in any drive position, the apparatus of the present invention will not interfere with normal operation of the vehicle. Use of the brake pedal while the vehicle is being driven will not actuate solenoid 16. However, upon shifting the gear train back into either park or neutral positions, first relay 64 will be actuated and solenoid 16 will again be energized until the brake pedal is depressed and released.

It should be noted that the present invention does not consume any power from the vehicle's battery at times when the vehicle is not in the park or neutral positions. Then, battery power is only required to energize first and second relays 60 and 70 and solenoid 16. Thus, battery consumption is minimal. Further use of the brake pedal during routine operation of the vehicle will not create any additional drain on the battery, since the two normally open contacts of K1 will not be closed.

The primary advantage of the present invention is to provide a vehicle safety device which will, at all times, prevent the application of unwanted fuel into the throttle or fuel injection system of a motor vehicle unless the vehicle operator intentionally places the vehicle drive lever in a drive or reverse position and releases the foot brake. Another advantage of the present invention is to provide a vehicle safety device which will not permit the motor vehicle to accidentally move unless the operator first depresses the brake foot pedal during or after engine startup and intentionally releases same, after being assured that the engine has not achieved high speeds.

Still another advantage of the present invention is to provide a mechanically sound vehicle safety device, functionally independent of the hydraulic system of a motor vehicle, thereby protecting against inadvertent dynamic coupling and interaction with such hydraulic system. The present invention is fully compatible with other safety systems incorporated into the motor vehicle, such as mechanical or electronic linkages between the brake pedal and gear lever to prevent physical movement of the gear lever by the operator unless the brake pedal is depressed. The apparatus of the present invention would function as an independent safety system in such a case, providing an additional failsafe feature and preventing unwanted engine acceleration during a brief period after placing the gear lever in a drive position and releasing the brake pedal.

Thus, there is disclosed in the above description and in the drawings an embodiment of the invention which fully and effectively accomplishes the objects thereof. However, it will become apparent to those skilled in the art how to make variations and modifications to the instant invention. Therefore, this invention is to be limited not by the specific disclosure herein, but only by the appended claims.

What is claimed:

1. Motor vehicle safety apparatus comprising:

a solenoid having a plunger-like rod, said rod being moveable in response to the energization of said solenoid, a safety plate, one end of said safety plate being coupled to a free end of said rod, the other end of said safety plate being engageable with an operating arm of the throttle or fuel injection system of the motor vehicle in response to the energization of said solenoid, and energizing means for energizing said solenoid, said energizing means being coupled to the gear train of the motor vehicle such that when the gear train is disposed out of park or neutral positions, said rod is moved so that said safety plate is not engaged with the operating arm, and when the gear train is in the park or neutral positions said rod is moved so that the other end of said safety plate prevents the operation of the operating arm.

2. The apparatus as claimed in claim 1, said energizing means further comprising:

an electrical circuit coupled to said solenoid and responsive to operation of a brake pedal of the motor vehicle, such that said solenoid is energized when the brake pedal is depressed when the gear train of the motor vehicle is in either the park or neutral positions.

3. The apparatus as claimed in claim 2, said electrical circuit further comprising:

means for delaying de-energization of said solenoid for a period of time following positioning the gear train of the motor vehicle into any position other than the park and neutral positions and upon releasing the brake pedal of the motor vehicle.

4. The apparatus as claimed in claim 2 wherein said electrical circuit does not cause the energization of said solenoid when the brake pedal is depressed when the gear train of the motor vehicle is in positions other than the park or neutral positions.

5. The apparatus as claimed in claim 4, said electrical circuit further comprising:

a first relay electrically coupled to a gear train operated switch and a power source of the motor vehicle which causes the energization of said first relay upon the vehicle's gear train being placed in a park or neutral position, a second relay coupled to said first relay and to a bake pedal operated switch of the motor vehicle which causes the energization of said second relay when the brake pedal is depressed and when said first relay is energized, wherein said energizing means energizes said solenoid upon energization of said first relay, and means for preventing de-energization of said solenoid for a period of time following de-energization of said second relay.

6. The apparatus as claimed in claim 1 wherein:

said safety plate is moved away from engagement with the operating arm when said solenoid is de-energized.

7. The apparatus as claimed in claim 1 further comprising:

a mounting plate having a pivot rod mounted thereon, wherein said safety plate is mounted on said pivot rod for pivoting about said pivot rod in response to the energization or de-energization of said solenoid.

8. The apparatus as claimed in claim 1 wherein:

said end of said safety plate engageable with the operating arm is disposed at substantially a right angle relative to a longitudinal axis of said safety plate.

* * * * *